US006598748B2

(12) United States Patent
Mileaf et al.

(10) Patent No.: US 6,598,748 B2
(45) **Date of Patent: *Jul. 29, 2003**

(54) LINE OF TRAVEL SEQUENCE TRANSFORMATION IN MAIL PROCESSING APPLICATIONS

(75) Inventors: Daryl S. Mileaf, Hanover, MD (US); Robert W. Laybourn, Arlington, VA (US)

(73) Assignee: Northrop Grumman Corporation, Los Angeles, CA (US)

( * ) Notice: Subject to any disclaimer, the term of this patent is extended or adjusted under 35 U.S.C. 154(b) by 78 days.

This patent is subject to a terminal disclaimer.

(21) Appl. No.: 09/855,610

(22) Filed: May 16, 2001

(65) Prior Publication Data

US 2002/0023861 A1 Feb. 28, 2002

Related U.S. Application Data

(63) Continuation-in-part of application No. 09/310,221, filed on May 12, 1999, now Pat. No. 6,241,099.

(51) Int. Cl.[7] ..... B07C 5/02

(52) U.S. Cl. ..... 209/542; 209/900; 209/540; 209/584

(58) Field of Search ..... 209/542, 900, 209/552, 584, 539, 540, 541, 545

(56) References Cited

U.S. PATENT DOCUMENTS 3,261,464 A * 7/1966 Levy ..... 209/552
4,503,977 A * 3/1985 Kohno et al. ..... 198/357
4,627,540 A * 12/1986 Takeda ..... 100/4
5,042,667 A * 8/1991 Keough ..... 209/3.1
5,119,954 A * 6/1992 Svyatsky et al. ..... 209/584
5,667,078 A * 9/1997 Walach ..... 209/584
5,901,855 A * 5/1999 Uno et al. ..... 209/584
5,924,576 A * 7/1999 Steenge ..... 209/584
6,239,397 B1 * 5/2001 Rosenbaum et al. ..... 209/3
6,241,099 B1 * 6/2001 Hendrickson et al. ..... 209/542
6,303,889 B1 * 10/2001 Hayduchok et al. ..... 209/509

FOREIGN PATENT DOCUMENTS

| | | |
|---|---|---|
| JP | 4200677 | 7/1992 |
| SU | 1623798 | 1/1991 |

* cited by examiner

*Primary Examiner*—Donald P. Walsh
*Assistant Examiner*—Mark J Beauchaine
(74) *Attorney, Agent, or Firm*—Birch, Stewart, Kolasch & Birch, LLP

(57) ABSTRACT

A method and system for re-sequencing mail prepared in enhanced carrier route line of travel (ECR-LOT) format into carrier walk sequence (CWS) format within a flat bundle collator (FBC) system. The mail items in LOT are separated into subsets, one subset being in the same order as CWS, and another subset being in reverse order to CWS. All items from all groups are then merged into a stream of items in CWS for delivery by mail carriers.

34 Claims, 16 Drawing Sheets

(15 of 16 Drawing Sheet(s) Filed in Color)

LINE OF TRAVEL SEQUENCE TRANSFORMATION IN MAIL PROCESSING APPLICATIONS

RELATED APPLICATION

This application is a continuation-in-part of prior application U.S. Ser. No. 09/310,221 filed May 12, 1999, now U.S. Pat. No. 6,241,099, the details of which are incorporated herein by reference and which is assigned to the assignee of the present invention.

BACKGROUND OF THE INVENTION

1. Field of the Invention

The present invention relates to a system and method for collating a plurality of items into a final sequenced set of the items in preparation for delivery to predetermined delivery points, some items being pre-sequenced according to a prioritized order reflecting the delivery points, and other items being in a different order than the prioritized order.

More specifically, the present invention and method relates to collating a plurality of mail items into a final sequenced set of the items for delivery to predetermined delivery points, some of the mail items being pre-sequenced in delivery point sequence (DPS) of selected carrier routes, and other mail items being in a different order from the delivery point sequence, all items then being merged into carrier walk sequence (CWS).

2. Description of Related Art

The United States Post Service (USPS) allows the mailing industry to prepare mail in a number of formats and sequences. Levels of savings incentives are provided to mailers to format the mail as closely as possible to the actual sequence that the mail is delivered. In doing so, the USPS creates internal savings by reducing the amount of processing and handling required to distribute and deliver the mail and passes a portion of this savings back to their customers through the incentives. For example, a mailing prepared to "carrier route" is prepared by separately packaging the product in bundles. Each bundle goes to a specific carrier at a specific post office. The USPS can then process this mail by shipping it directly to the specific post office rather than shipping it through a number of distribution facilities and processing it within those facilities. At the specific (destination) post office, the clerks can simply distribute each bundle to the appropriate carrier, rather than having to break down bundles and sort the mail within the bundle to the carriers. At each step in the distribution process, savings are realized by reducing the amount of processing required.

As carriers receive their mail for the day, they sort the mail in into what is referred to as "Carrier Walk Sequence". They do so by "casing" the mail. This operation is the process of placing each piece of mail into a cubbyhole in a matrix of cubbyholes. This is done in such a manner that by placing and then removing the mail from the cubbyholes the carrier creates a bundle of mail that is in exactly the sequence that they will deliver it. All mail for each address in the route is together. As the carrier walks or drives their route, they simply remove mail from the top of the bundle at each stop. Various metrics are used to determine the rate at which mail can be cased. Mail presented to the carrier in walk sequence can be cased much faster than purely random mail. Typically a carrier cases random mail at 8 pieces per minute and sequenced mail at 18 pieces per minute. In order to facilitate more productive casing operations, the USPS will pass a portion of the savings created by sequenced mail back to the mailers in incentives (i.e. mailers are charged less per piece to mail a sequenced mailing than to mail a random mailing).

Recently, the USPS has identified the need for a Flats Bundle Collator (FBC), such as the system disclosed in the aforementioned parent application U.S. Ser. No. 09/310,221, now U.S. Pat. No. 6,241,099. This system takes multiple flats (periodicals and similarly sized mail) mailings and automatically collates them together into a single bundle similar to the output of the carrier casing operation. In order to perform this operation, it was '25 thought that each individual mailing would preferably be in carrier walk sequence and the system would then simply collate the sequenced mailings together. While this constraint is true for most collating systems, this invention describes a process that would eliminate this constraint for the Flats Bundle Collator by intelligently applying the inherent characteristics of the system design.

It is widely accepted in mailing and USPS circles that mailers would be provided incentives and would therefore provide mailings configured for processing on a Flats Bundle Collator. There are, however, a number of compelling reasons for expanding the capabilities of the Flats Bundle Collator described in U.S. Ser. No. 09/310,221, now U.S. Pat. No. 6,241,099, to process mailings that do not meet the criteria for these incentives.

There are a number of mail preparation options that are offered to mailers by the USPS. These options are tailored to accommodate varying mailing parameters such as the number of pieces per mailing, the density of mail per route, zone, or area, bar coding and addressing levels and the mail type itself (1st class, Standard A, or periodical). Within these options mailers determine the most cost-effective means of preparing and shipping their product.

This determination takes into account the time sensitivity of the mailing, the preparation costs and the mailing costs. To facilitate this process, the USPS provides customer data with regard to routes, zones and areas. The USPS does not provide mailers with complete sequence information (i.e. complete route information including 11 digit bar codes and the carrier walk sequence) to protect the privacy of its customers. The USPS does provide increasing levels of detail including zone and route customers and some modified sequence data (with corresponding incentives) constructed to maintain customer privacy but allow for casing operations to be more productive than casing random mail.

Currently, a large portion of flats mailings are prepared in a configuration know as Enhanced Carrier Route Line Of Travel (ECRLOT). This configuration provides flats in a quasi-sequence that overlaps Carrier Walk Sequence to varying degrees depending on the route itself and the carrier walk sequence. It is this configuration (LOT) and some levels of random mail that this invention addresses. The basic construction of LOT mailings is based on the concept (or mechanism) of "Block Faces". A Block Face is a representation of a portion of the carrier route. Typically a Block Face includes both a range of zip codes and a direction of travel (either ascending or descending addresses within the block face). Rather than providing the complete sequence of stops on a route LOT creates a series of sequences in Block Faces (and directions) that provides a varying degree of correlation to the carrier route depending on the route itself and nature of the LOT for that route. A typical example of a "Carrier Walk Sequence—vs.—Line Of Travel" is as follows. An imaginary carrier has a route that consists of only one street with 20 addresses on it. The carriers walk sequence is to deliver up the odd side of the street and then down the even side of the street. The Carrier Walk Sequence for this route is 1,3,5,7, . . . 19, 20, 18, 16,14 . . . 2. An LOT for this route could be represented as stops "1–20 A" (ascending) on that street. The mailer would prepare the mail for this route as 1,2,3,4,5 . . . 20. Ideally, the LOT for this route would divide the route into two block faces; one for the ascending odd-side of the street and one for the descending even side of the street. This construction would create a 100% correlation between the LOT and actual carrier walk sequence. In practical terms, carrier routes are much more complex than a single street and carriers often deliver to a portion of a street, turn off onto side streets and eventually return to the remainder of the original street. While it is not uncommon for a single street to be represented by multiple block faces to account for this, there is a varying degree of difference between the actual walk sequence and mailings created in LOT.

For the purpose of illustration, we will assume that the route is represented by a single block face. In the next example, we will illustrate the impact of two different block face representations for a small route consisting of three streets.

TABLE 1

Carrier casing operations example for one street route represented by one block face

| | | | | |
|---|---|---|---|---|
| 1 (1) | 3 (2) | 5 (3) | 7 (4) | 9 (5) |
| 11 (6) | 13 (7) | 15 (8) | 17 (9) | 19 (10) |
| 20 (11) | 18 (12) | 16 (13) | 14 (14) | 12 (15) |
| 10 (16) | 8 (17) | 6 (18) | 4 (19) | 2 (20) |

The table 1 above represents a portion of the carrier case from the previous example. Cases are set up so that carriers can place mail into the cubbyholes and after all of the mail is cased it can be removed in order so that the bundle of mail coming out of the case is in the carrier's walk sequence. The first numbers in the table represent the street address on the route where the mail in that cubbyhole will get delivered. The numbers in parenthesis denote the delivery sequence point of that home. For example, 15 (8) means that house number 15 on that street is the $8^{th}$ delivery point. In the above example, the carrier would have to case an LOT mailing by placing the first piece in the upper left cubbyhole 1(1), the second in the lower right cubbyhole 2(20), the third in the cubbyhole marked 3(2) and so on. Generally, this is slightly more efficient than completely random mail, however, it is not as efficient as it would be if the mail were prepared in the order 1,3,5,7,9,11,13,15,17,19,20,18,16,14, 12,10,8,6,4,2. If the mail were prepared in that order, the carrier would know that the next piece in the mailing would be downstream (right or on the next lower tier) of the previous piece. By always moving right and lower into the case, the carrier is able to case the mail at a rate approximately three times faster than casing random mail.

Pragmatically, most mailings do not go to every house. Usually a mailing (i.e. Time magazine) is delivered to a small percentage of a carrier route. In the above case, a real mailing might only go to 4 houses. This tends to eliminate patterns and trends in the casing operation and leads to casing rates closer to random mail. This example demonstrates casing for a single street.

Carrier routes typically encompass a number of streets. Nationally, the average carrier route is approximately 400 stops. In many instances the carrier will turn off of a street onto another street (or cul-de-sac) and then return to the street to continue deliveries. In LOT configuration, each street may be prepared in whole and the casing operation addresses placing the turn-off street, or cul-de-sac into the correct sequence (in the middle of the original street). Each carrier also receives a number of mailings to process each day, so the casing process inefficiencies are repeated multiple times each morning.

In this example, approximately 50% of the mail pieces would have to be rejected as "out of sequence" on machinery designed to merge sequenced mail pieces because the machinery would be processing the mail to the carrier walk sequence. (The LOT configuration creates a mailing where every other mail piece does not meet the walk sequence construction if a mailing contained one piece for address on the route.)

SUMMARY

Accordingly, it is a primary object of the present invention to collate out-of-spec items, such as mail items in line of travel delivery point sequence (LOT), with mail items in carrier walk sequence (CWS).

It is another object of the present invention to provide a method and system for processing random items rejected as errors by a flats bundle collator system by reintroducing the rejected item as part of a repaired sequence.

The objects of the present invention are fulfilled by providing a method of collating a plurality of mail items into a final sequenced set of the items for delivery to predetermined delivery points, some of said mail items being pre-sequenced in delivery point sequence (DPS) of selected carrier routes, and other mail items being in a different order from the delivery point sequence, comprising the steps of:

a) feeding the mail items from a single input stream to a staging station;

b) sampling each mail item in the input stream to determine if the mail item is in the delivery point sequence, or a different order;

c) sorting the mail items at the staging station into a plurality of subsets of mail items re-sequenced into an intermediate order as an intermediate step to achieving said final sequenced set, said staging station having a plurality of storage units $X_1$ to $X_n$, wherein n is the total number of storage units, said storage units temporarily storing said items in said subsets by;

1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items;

2) rearranging the mail items in the different order into delivery point sequence (DPS) in the staging station by inserting those mail items into selectable storage units; and 3) selectively extracting the mail items from any selected one of the storage units $X_1$ to $X_n$ according to said extraction plan; and d) merging the extracted mail items into a single output stream from the respective subsets of mail items into said final sequenced set in delivery point sequence (DPS).

The method further includes collecting portions of the output stream of the mail items in delivery point sequence and reversing the order thereof into batches of mail items in carrier walk sequence (CWS). The different order is in enhanced carrier route line of travel (LOT), as defined by The United States Postal Service, such that some of the mail items therein are sequenced corresponding to some of the delivery points of mail items in the delivery point sequence (DPS). LOT is determined as a function of block face identity, and direction of carry walk sequence (CWS) in that block, said block face identity representing a side of a street on a carrier delivery route.

The step of rearranging includes the steps of:

a) feeding a single input stream of mail items in the LOT group into a staging station;

b) determining which items in the stream are in order with the order of CWS, and which are in reverse order with respect thereto;

c) separating the in-order items and reverse-order items into separate subsets of items in the staging station; and d) recombining the subsets in the staging station into one sequenced group of items in CWS.

The objects and aspects of the present invention will become more readily apparent by reference to the following drawings.

BRIEF DESCRIPTION OF THE DRAWINGS

The patent or application file contains at least one drawing executed in color. Copies of this patent or patent application publication with color drawing(s) will be provided by the U.S. Patent and Trademark Office upon request and payment of the necessary fee.

The following drawing figures depict various aspects of the present invention, wherein.

DETAILED DESCRIPTION OF THE INVENTION

Figure 1:
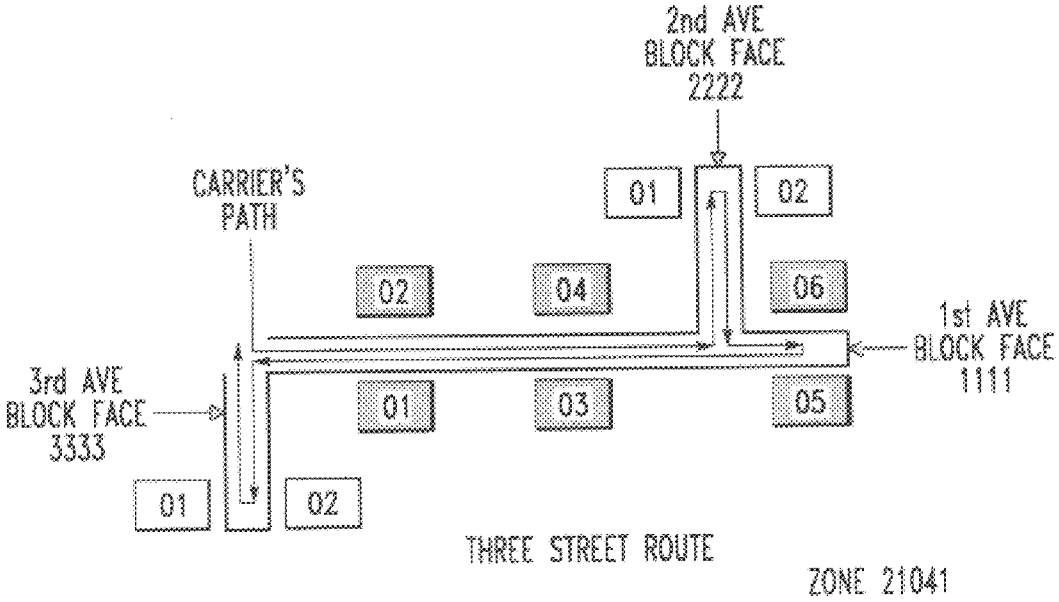
FIG. 1 is a schematic diagram depicting a typical three (3) street route for block faces delineated for each street.

Referring now to the drawings, FIG. 1 depicts a small, three-street route. The carrier travels up the even side of 1$^{st}$ Avenue, turns off onto 2$^{nd}$ Avenue, returns to complete 1$^{st}$ Avenue and then finishes the route by turning onto 3$^{rd}$ Avenue. This route consists of ten delivery points in the carrier walk sequence. Delivery points are delineated by an 11 digit ZIP code. ZIP codes are constructed in three levels of granularity; 5 digit, 9 digit and 11 digit. Each level of granularity creates a corresponding level of detail in the address(es) that the ZIP code represents. 5 digit ZIP codes represent all addresses within a postal zone. For example, the ZIP code 21041 represents a postal zone in Annapolis, Maryland. There is no mechanism within a 5 digit ZIP code to identify one address from another within that 5-digit zone without including other information on the address label (i.e. the written address). 9 digit ZIP codes represent Block Faces within the 5-digit zone (i.e. the extra four digits, 1111, identify a street, or portion of a street within Annapolis). Again, there is no mechanism within the 9-digit ZIP code to identify one house from another on that Block Face. 11 digit ZIP codes identify a specific, unique address within a Block Face within a Zone (i.e. The extra 2 digits, 01, represent house number 01 on 1$^{st}$ Avenue in Annapolis, Md).

The carrier walk sequence for this route is shown by arrows. The LOT block faces for this route are as follows:

1$^{st}$ Avenue is block face 1111 (i.e. Zip code 21041 1111)

2$^{nd}$ Avenue is block face 2222

3$^{rd}$ Avenue is block face 3333

The following example in Table 2 demonstrates the impact of different block face representation for a small route of items arranged in LOT for merging with items in CWS.

TABLE 2

Sequence Structures for route of FIG. 1.

| Carrier Walk Sequence | Mailer LOT instructions | LOT Mailing Sequence |
|---|---|---|
| 1. 21041-1111-02 | 1. 21041-1111-00/99 A | **1. 21041-1111-01** |
| 2. 21041-1111-04 | 2. 21041-2222-00/99 A | 2. 21041-1111-02 |
| 3. 21041-2222-01 | 3. 21041-3333-99/00 D | **3. 21041-1111-03** |
| 4. 21041-2222-02 | | 4. 21041-1111-04 |
| 5. 21041-1111-06 | | **5. 21041-1111-05** |
| 6. 21041-1111-05 | | 6. 21041-1111-06 |
| 7. 21041-1111-03 | | **7. 21041-2222-01** |
| 8. 21041-1111-01 | | **8. 21041-2222-02** |
| 9. 21041-3333-02 | | 9. 21041-3333-02 |
| 10. 21041-3333-01 | | 10. 21041-3333-01 |

The left column of Table 2 (Carrier Walk Sequence) shows the order in which the carrier delivers mail on the route shown in FIG. 1. Delivery (or sequence) point 1 is 21021-111-02. The center column shows the mailer instructions for creating an LOT mailing for the route and the right column shows the sequence of mail within the LOT mailing (mail piece 1 is 21041-1111-01). Boldface, italicized numbers indicate mail pieces that would be out of sequence with respect to the walk sequence. Instruction 1 (one) for the mailers directs the mailer to begin the mailing with all addresses on 1$^{st}$ Avenue in ascending (A) order (the 00/99 A indicates street addresses ending in 00 to 99 in ascending order). This creates the first six points in the LOT mailing sequence. Instruction 2 directs the mailers to follow those pieces with the addresses for 2$^{nd}$ Avenue, also in ascending (A) order. Finally, instruction 3 directs the mailer to follow the 2$^{nd}$ Avenue addresses with the 3$^{rd}$ Avenue addresses in descending (D) order. The mailing created by these instructions has a number of pieces that would be identified as "out of sequence" by automated processing equipment. Depending on the algorithms employed by the equipment, different pieces would be rejected. Some equipment would reject the first eight pieces as none of them correlate to the walk sequence. If the first piece were to be processed, then every other piece up to the ninth piece would have to be rejected, as that is the piece that immediately follows in the walk sequence. More sophisticated algorithms could identify the first piece as out of sequence and salvage a maximum 5 of the pieces for processing. The carrier case for this route is show in Table 3 below.

TABLE 3

Casing a LOT route

| | | | | |
|---|---|---|---|---|
| 21041-1111-02 | 21041-1111-04 | 21041-2222-01 | 21041-2222-02 | 21041-1111-06 |
| 21041-1111-05 | 21041-1111-03 | 21041-1111-01 | 21041-3333-02 | 21041-3333-01 |

The arrows shown in Table 3 indicate how the LOT mailing would be cased (starting in the center box of the lower tier). Conversely, Table 4 depicts how a mailing in carrier walk sequence would be cased for the same route.

TABLE 4

Casing a Carrier Walk Sequence Mailing

| | | | | |
|---|---|---|---|---|
| 21041-1111-02 | 21041-1111-04 | 21041-2222-01 | 21041-2222-02 | 21041-1111-06 |
| 21041-1111-05 | 21041-1111-03 | 21041-1111-01 | 21041-3333-02 | 21041-3333-01 |

As tables 3 and 4 show, the use of LOT for this route causes a wide divergence from the walk sequence and does little to simplify the casing operation. Analogously, an automated operation would have to either "repair" the sequence order of the mailing to reflect the output of the casing operation or reject a large percentage of the mailing. The use of LOT mailing creates a wide range of differences between the mailings and the carrier walk sequence.

Figure 2:
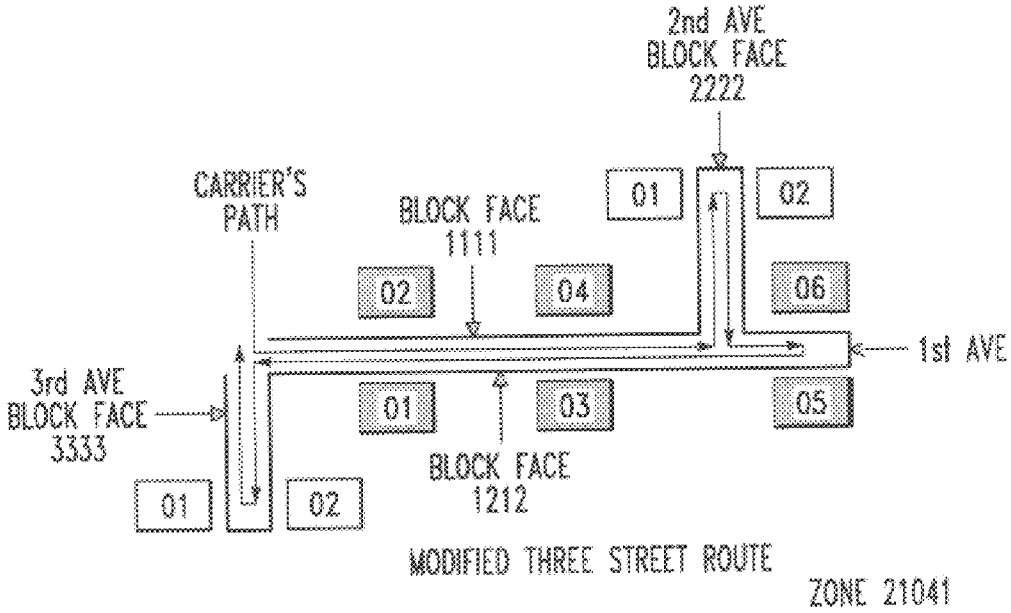
FIG. 2 is a schematic diagram depicting a modified three (3) street carrier route.

The following example as depicted in FIG. 2 illustrates a slightly different LOT construction (an additional block face) for the same route that greatly reduces this divergence. In such a construction, 1$^{st}$ Avenue has been divided into two block faces with houses 2, 4 and 6 on block face 1111 and houses 1,3 and 5 on block face 1212. The carrier still travels the route in the same walk sequence. Table 5 depicts the sequence structure for a LOT mailing created with this structure.

TABLE 5

Modified Sequence Structures for route of FIG. 2.

| Carrier Walk Sequence | Mailer LOT instructions | LOT Mailing Sequence |
|---|---|---|
| 1. 21041-1111-02 | 1. 21041-1111-00/99 A | 1. 21041-1111-02 |
| 2. 21041-1111-04 | 2. 21041-2222-00/99 A | 2. 21041-1111-04 |
| 3. 21041-2222-01 | 3. 21041-1212-00/99 D | **3. 21041-1111-06** |
| 4. 21041-2222-02 | 4. 21041-3333-99/00 D | 4. 21041-2222-01 |
| 5. 21041-1111-06 | | 5. 21041-2222-02 |
| 6. 21041-1111-05 | | 6. 21041-1212-05 |
| 7. 21041-1111-03 | | 7. 21041-1212-03 |
| 8. 21041-1111-01 | | 8. 21041-1212-01 |
| 9. 21041-3333-02 | | 9. 21041-3333-02 |
| 10. 21041-3333-01 | | 10. 21041-3333-01 |

The use of two block faces for 1$^{st}$ Avenue (one for the even side of the street and one for the odd side of the street) leads to the creation of an LOT mailing that differs from the carrier walk sequence by only one mail piece. Only the mail piece for house number 06 on 1$^{st}$ Avenue is now out of sequence.

It should be noted that carrier routes throughout the United States vary greatly in size and layout. In some areas, the carriers travel in a nearly perfect grid traversing whole streets and then moving to the next street. In other areas, carriers often leave and return to the same street many times as they make deliveries on Cul-de-sacs, intersecting streets and set back areas with single points of access. In practice, most routes are compilations of many areas similar to the examples given. Each route has a unique walk sequence and each route has a specific Line of Travel construction for mailers to use. Each route has a corresponding variation between the two. This variation itself is variable as very few mailings are delivered to all of the delivery points on a particular route. Most mailings are addressed to a small potion of a route and the variation between LOT and walk sequence for each mailing is dependent on the addresses within the mailing.

In the example above, if a mailing of *Time* magazine included all of the even house numbers on every street and a mailing of *Newsweek* included every odd house number on every street, the *Newsweek* mailing would have no out of sequence pieces while the *Time* would. The delivery points for the *Newsweek* mailing would be 3,6,7,8,10; all in order. The delivery points for the *Time* mailing would be 1,2,5,4,9 with points 5 and 4 out of order due to the LOT construction. In the previous example, with a single block face for 1$^{st}$ Avenue, the same mailings (all odd, all even) would yield much different results. The delivery points for the *Newsweek* mailing would be 8,7,6,3,10. In this case, three pieces would be out of sequence as any variation of analysis can produce only 2 pieces in sequence (i.e. 8/10, 7/10, 6/10 or 3/10). The *Time* delivery points would not change (1,2,5,4,9) and would still include one piece out of sequence (1/2/5/9 or 1/2/4/9 would be considered in sequence).

These examples demonstrate this phenomenon as applied to very simple cases. The complexities, and size, of route construction and the random nature of who gets what mail on what route compound the possible variations by orders of magnitude. Essentially, this reduces the nature of collating mail in LOT configuration to a requirement of collating potentially random mail (as compared to the carrier walk sequence). Multiple feeder systems cannot efficiently process this mail as they would have to reject (i.e. not process) any out of sequence pieces.

According to the present invention, a method and system of processing have been designed for a Flats Bundle Collator that enables the system to process LOT mailings by repairing (i.e. manipulating into carrier walk sequence) the sequence of mailings within the system staging devices.

Figure 3:
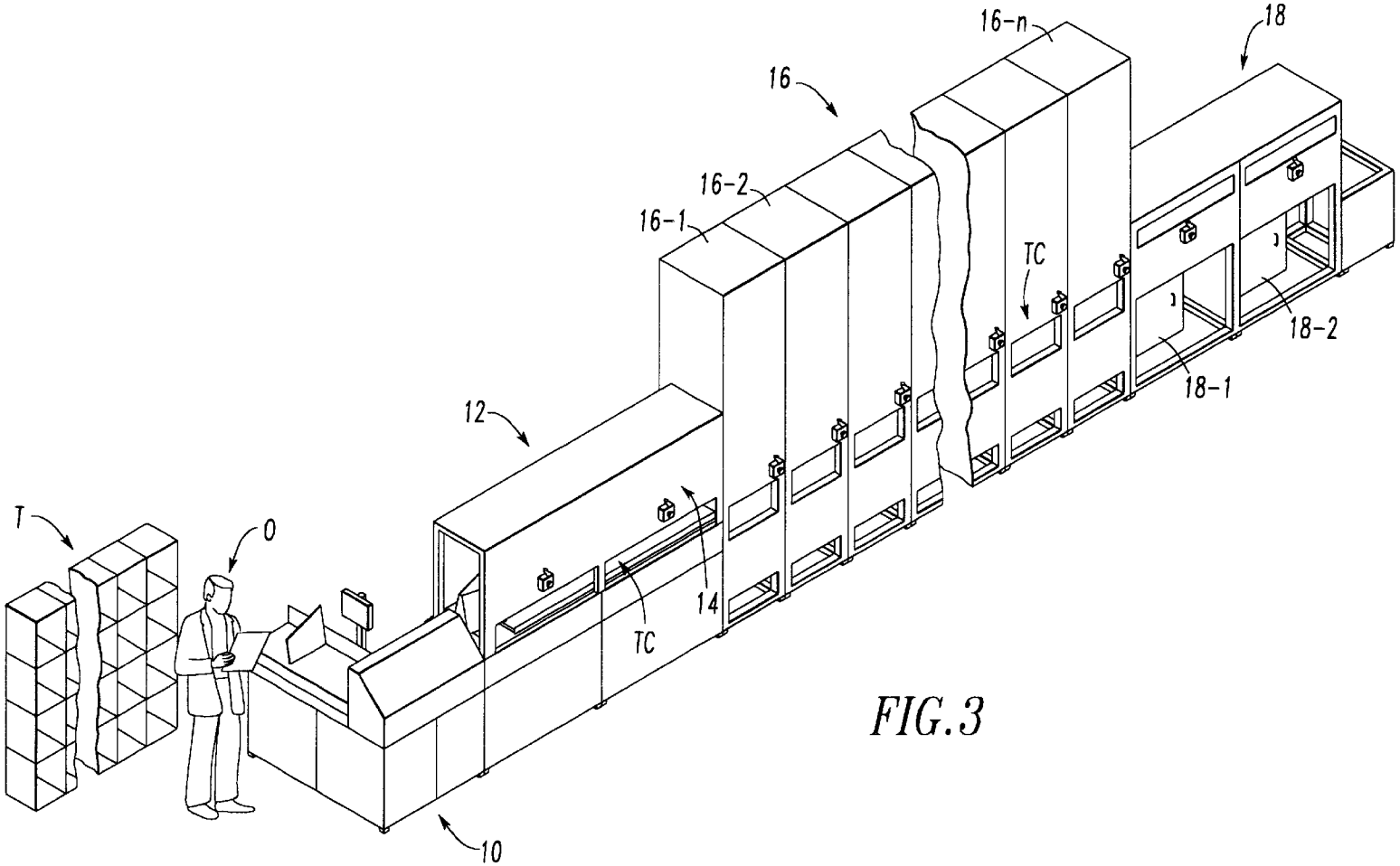
FIG. 3 is a perspective view of the Flats Bundle Collator (FBC) of the above referenced related application U.S. Ser. No. 09/310,221, now U.S. Pat. No. 6,241,099.

Considering now the Flats Bundle Collator system of FIG. 3, carrier casing operations are manually intensive and expensive. There are approximately 300,000 routes in the United States and each route is manually cased in the morning. Typically, this activity takes an average of 3 hours to perform before the carrier has all the mail prepared for delivery. Approximately 10 years ago, the USPS developed sorting technology for letter mail to provide carriers with letters already in walk sequence. This technology accomplished this by performing multiple sorting passes (i.e. processing the same mail on a machine two or three times). This technology eliminated the need for carriers to case most of their letter mail and produced cost savings. Recently, the USPS has sought to develop, or purchase technology to perform the same function on flats mail. Most cased mail is flats mail. The system is based on a set of USPS assumptions and requirements, the most important of which is that mailers will be given incentives to provide flats mail in mailings that are in carrier walk sequence. Based on that assumption, a system was designed to process this mail in a single pass of collating rather than multiple passes or sorting. Such a system is described in parent application Ser. No. 09/310,221 filed May 12, 1999, now U.S. Pat. No. 6,241,099, and is generally illustrated in FIG. 3.

One approach to the proposition of collating multiple bundles of mail that is already in sequence is to use a multiple feeder system design. Each feeder has one mailing loaded into it and the system simply reads the next piece off of each feeder and determines how to merge the pieces together. The resulting bundle of mail at the system output is in sequence (i.e. *Time* for stop 22 gets put between the *Newsweek* for stops 20 and 23 etc.).

The Flats Bundle Collator design of FIG. 3 is a single feeder system that uses a number of staging towers to store mail in process. The system uses a two-phase processing approach. Mail is initially fed into the system and then fed out during the collation stage. As mail is fed into the system, the towers are populated in the walk sequence. The system maintains an inventory of the location of each stored mail piece. During the collation process, the mail is fed back onto the system conveyor such that the output is a single bundle of mail in walk sequence.

Mail pieces are merged together after they have been singulated (separated in to single mail pieces), read (using a bar code reader and/or an optical character reader) and staged. This allows for processing alternatives beyond collating such as sequencing and sequencing repair (i.e. processing out of sequence pieces back into sequence using multiple manipulations within the tower staging system).

Referring now to the present invention, the system shown in FIG. 3 includes the following components: a feeder assembly 10; a combined orienter/reader assembly including a transport conveyor TC, a flats orienter module 12, a barcode reader module 14; a staging tower assembly 16 including multiple staging towers 16-1, . . . , 16-n; and a containerizer module 18 including two containerizer assemblies 18-1 and 18-2. Bundles of mail in the United States Postal System (USPS) mail tubs T are loaded onto the feeder assembly 10 by an operator O. The mail is first oriented to have the mailing label up by the orienter module 12. The address is then read by the barcode reader module 14. All of the mailings F, except for the last, are staged in the staging tower assembly 16. Mail is removed from the multiple staging towers as the last mailing is fed from the feeder 10 in such a way as to make the mail stream in a desired final sequence. The mail is conveyed out of the staging tower assembly 16 to the containerizer module 18, where it is stacked in selected ones of USPS tubs, not shown. Multiple pre-sequenced mailings can be fed into the machine. Each mailing can consist of several bundles of mail, each bundle containing several pieces. Each mailing is in delivery point sequence (DPS) or carrier walk sequence (CWS).

The operator O places all but the last mailing in the feeder 10 with the lower number stop in the first position. The feeder 10 then removes one piece of flats mail F at a time from the stack and injects it into the flats orienter module 12. The feeder 10 will feed all of the mail in this manner until it reaches the last mailing. The last mailing is loaded with the lowest number stop in the last position.

If a saturation mailing (a mass mailing) is not to be included in the sorting process, the operator notifies the system that loading is complete by pressing a button on the system control panel to be described hereinafter. However, if there is a saturation mailing, the operator notifies the system and begins loading the saturation mailing into the feeder 10. The system compares the contents of the staging tower assembly 16 to the carrier's walk sequence and calculates the output sequence to collate the system contents into the sequence. If there is not a saturation mailing, the system calculates the output sequence directly from the tower contents. If a saturation mailing is included, the system calculates the output sequence from the towers 16-1, . . . , 16-n and includes the feeder 10 saturation output in the collation calculation.

The tower assembly 16 outputs the flats F, and the feeder 10 inputs saturation flats, if they are present, such that they are transported into the mail tubs in the containerizer module 18. The operator O then removes the tubs and prepares to input the next carrier route bundles into the system.

Flats Bundle Collation (FBC) System Operation

The FBC shown in FIG. 3 operates in the following manner:

- Flats are loaded into the feeder, singulated, scanned and staged in the towers
- A control process designed to maximize the tower utilization determines the staging location for each flat. In general, the process stages flats for any mailing in the same tower, however, if it finds a more efficient place to place the flat in another tower, it directs the flat there. Each tower contains flats in sequence; the process merely seeks to pack the sequence in any tower more densely. This process also allows the FBC to process some out of sequence flats (up to 5% are permitted in the DMM (Domestic Mail Manual), by finding locations to stage them.
- On routes without saturation (or large) mailings, the operator will notify the system that all flats have been inducted and the system will compare the contents of the towers to the carrier walk sequence and determine the output sequence to release the flats from the towers in walk sequence.
- On routes with saturation (or large mailings), the operator will notify the system that a saturation mailing is ready to be fed. The system then compares the contents of the towers, the flats being read from the feeder and the carrier walk sequence to collate the saturation mailing with the tower output. This is done "on the fly" such that they are in walk sequence (essentially, the controller treats the feeder as a virtual tower for this and continually updates the tower output sequence based on the feeder flats).

The flats are conveyed to an output module that features side-by-side containerizers. After one tray fills, the system diverts flats in to the other tray allowing the operator to remove and reload trays in parallel with system output.

The serial nature of processing allows the same operator to feed and "sweep" the machine The operator returns to the feeder to process the next carrier Process Modifications for Sequence Repair of LOT Mailings There are two fundamental differences between a carrier walk sequence and mail prepared in LOT. The use of either ascending or descending block faces and the order in which block faces are sequenced within a mailing. In the first case (ascending and descending block faces), the mail may be prepared in a direction opposite that which the carrier travels. In many cases, this is due to single block face being applied to a street where the carrier travels up and down the even and odd sides of the street as shown in the example depicted in Table 2. The result of this is that alternating pieces of mail are out of sequence and reversed with regard to their ascending or descending nature. The second common occurrence is when a carrier leaves a street on an intersection, such as cul-de-sac and then returns. In many cases, the block face structure is such the second block face (the cul-de-sac) follows the first sequentially in the LOT sequence. In this case the LOT mailing places all pieces for the cul-de-sac after all pieces for the original street as shown in the example in Table 5. In this example house number 06 on $1^{st}$ Avenue is sequenced before all of the houses on $2^{nd}$ Avenue in contrast with the carrier walk sequence in which they are delivered first. There are other variations of these themes, which can occur such as a carrier leaving and returning to a street multiple times causing multiple offsets of block faces. If the route in the example had two cul-de-sacs that intersected $1^{st}$ Avenue and that side of $1^{st}$ Avenue remained a single block face, then both cul-de-sac mail pieces would be sequenced after house 06 on $1^{st}$ Avenue.

To address these types of errors, a system must do the following to properly process the mail into carrier walk sequence:

1. Reject all pieces that are out of carrier walk sequence. This approach has a significant detrimental effect as all reject pieces must then be manually processed, or
2. Segregate out streams of mail pieces that are in carrier walk sequence but offset from their true position in the carrier walk sequence and then place them into the true position. In the example (Table 5), cul-de-sac pieces would be removed from the stream and then placed where they belong (prior to house 06 on $1^{st}$ Avenue). Conversely, the mail piece for house 06 can be removed and placed behind the mail pieces for $2^{nd}$ Avenue if this is more efficient.
3. Segregate out mail pieces that are in reverse sequence, reorder them and then inject them into true position.
4. Any combination of 2 and 3 as required.

The Flats Bundle Collator, shown in FIG. 3 implements the present invention, by using the staging system to reorder LOT mailings into carrier walk sequence by manipulating the mailings within the staging system 16. Mailings are segregated into ascending and descending portions in the towers 16-1, . . . 16-n and then reordered and recombined into carrier walk sequence (CWS). These manipulations on individual mailings are performed in parallel with other mailings being fed into the system. As a mailing is fed into the system, trends are analyzed and "mini mailings are created" within separate towers. Mini mailings consist of route portions in sequence, either ascending or descending with regard to the carrier walk sequence.

Figure 4A:
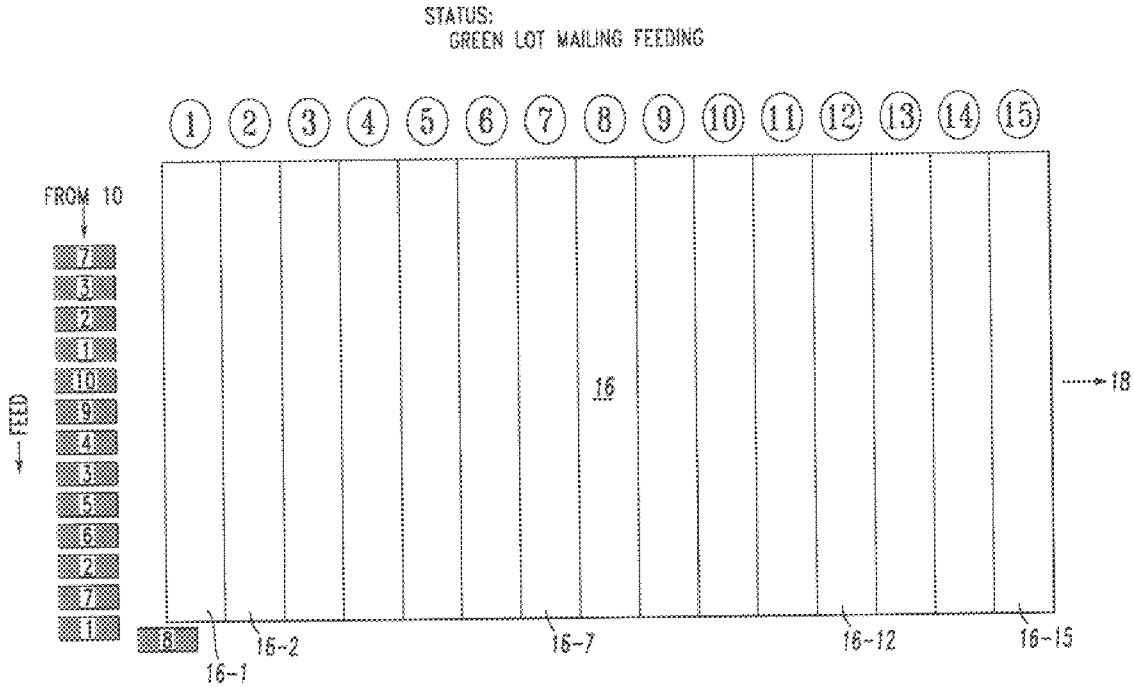
FIGS. 4*a* to 4*n* are diagrammatic illustrations of how the staging towers of the Flats Bundle Collator (FBC) system of FIG. 3 are utilized to perform sequence repair on LOT items for merging into other groups of items input to the system in carrier walk sequence (CWS).
Figure 4B:
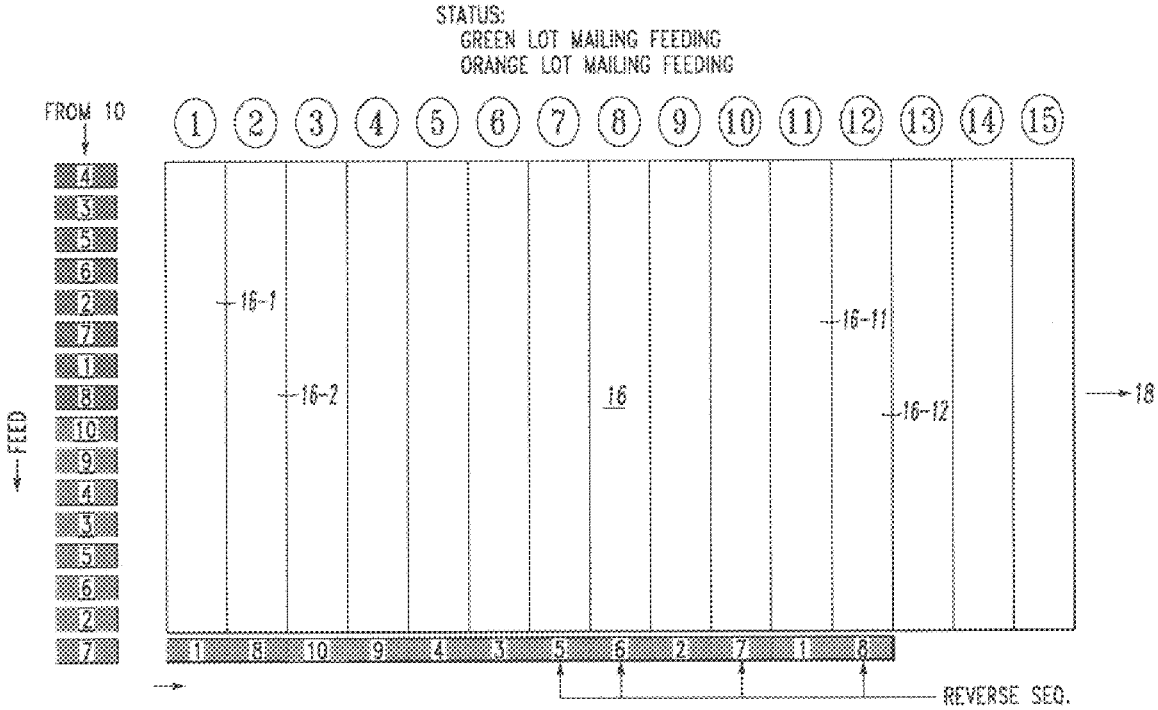
Figure 4C:
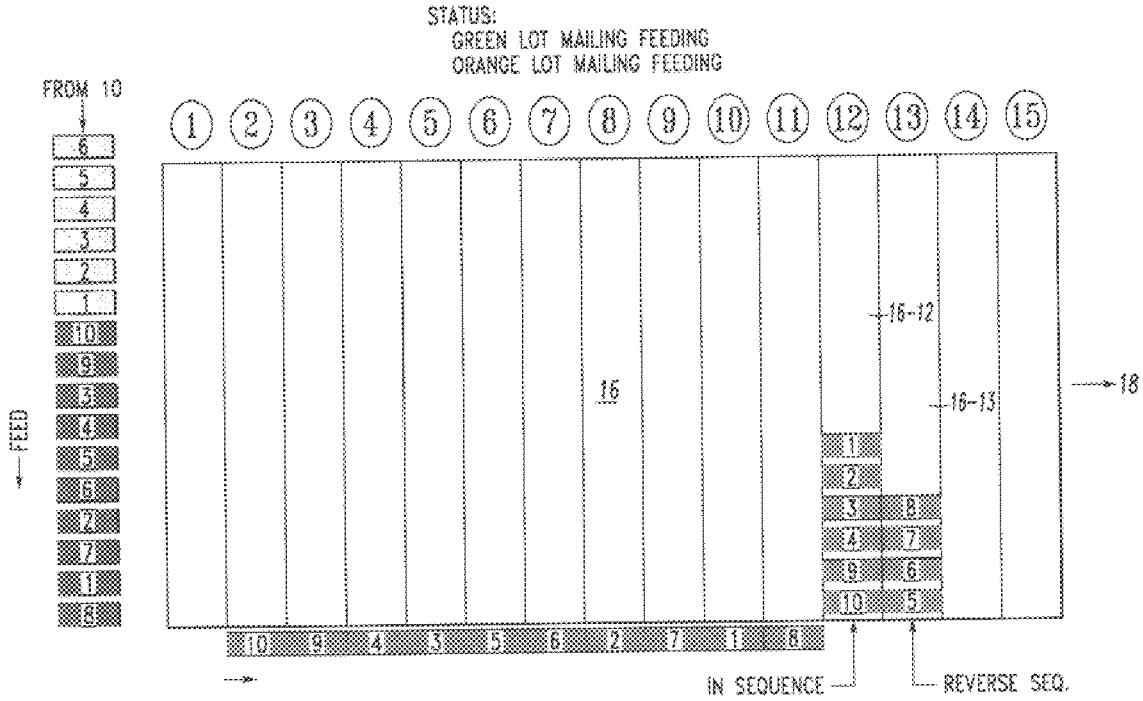
Figure 4D:
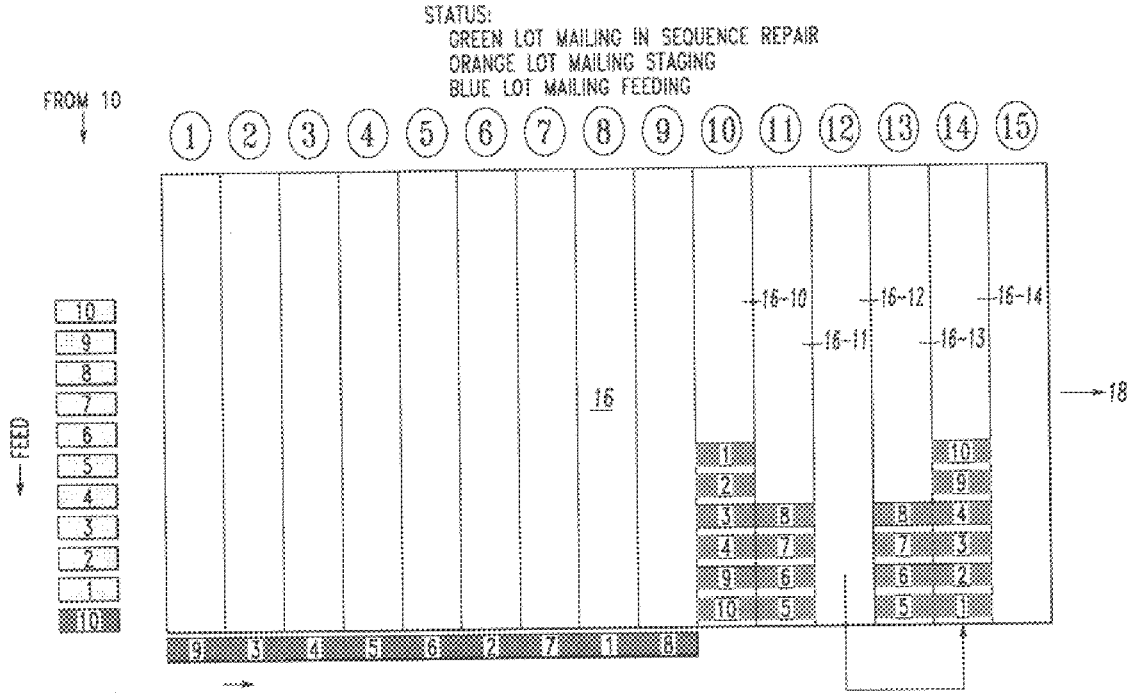
Figure 4E:
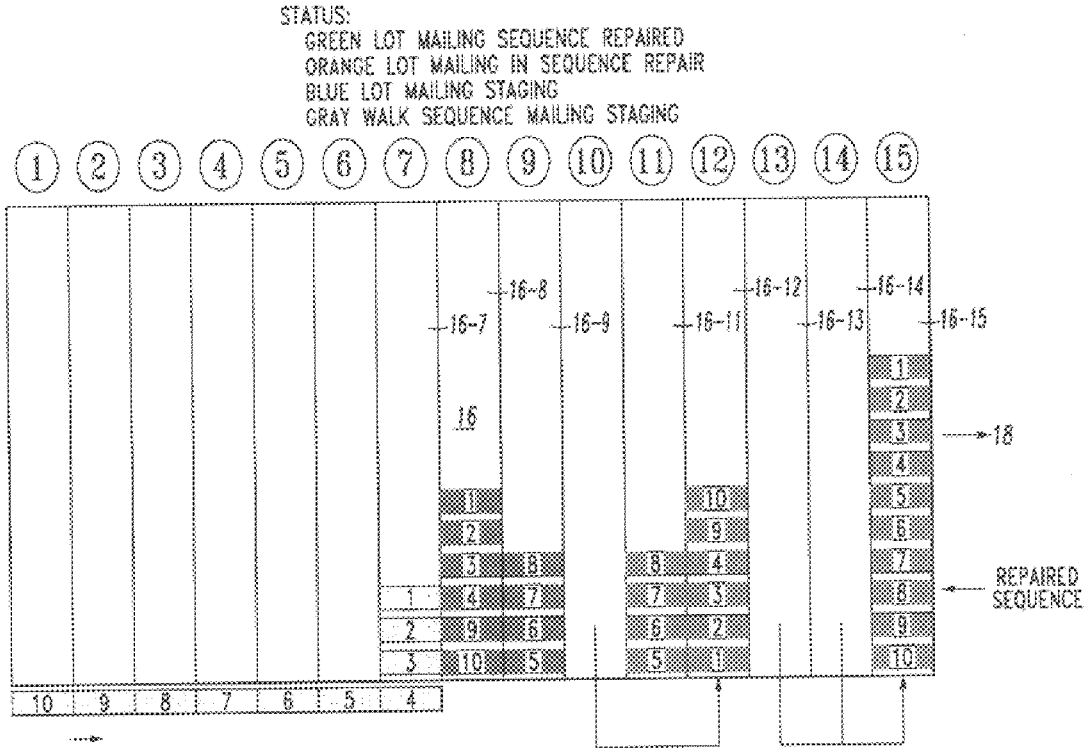
Figure 4F:
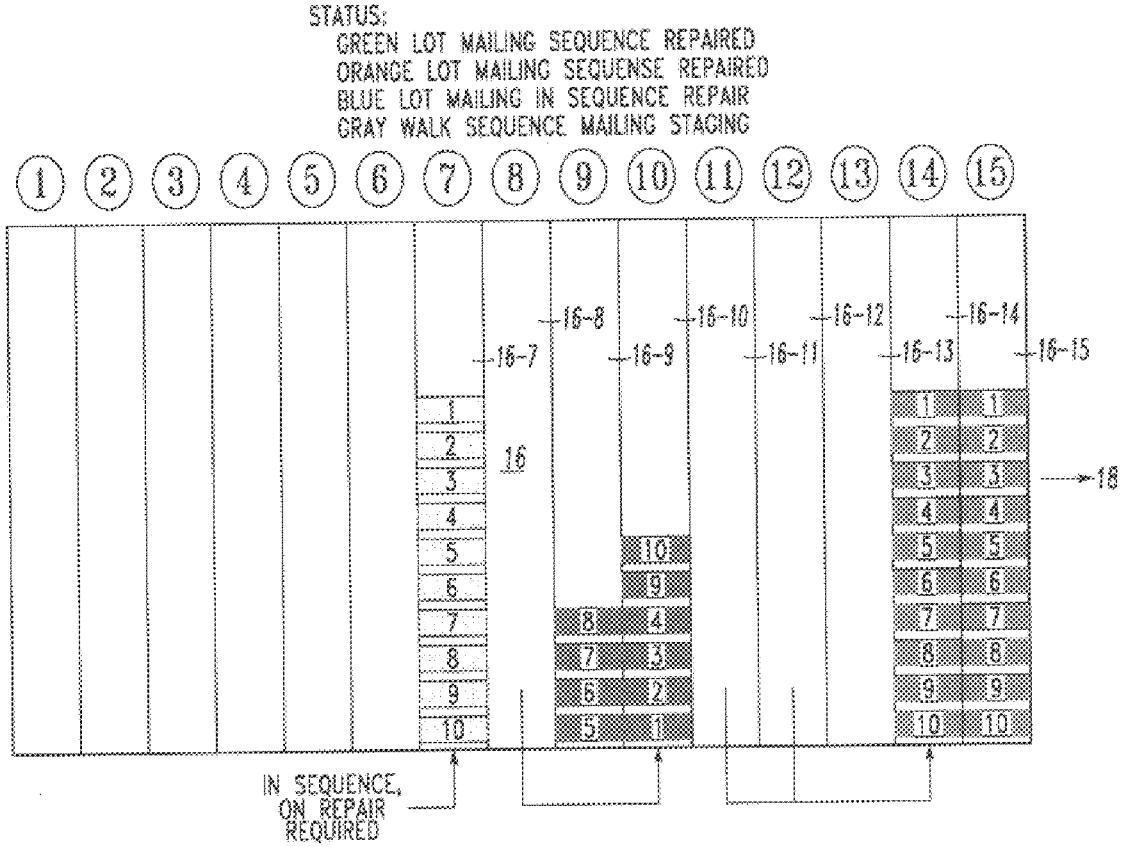
Figure 4G:
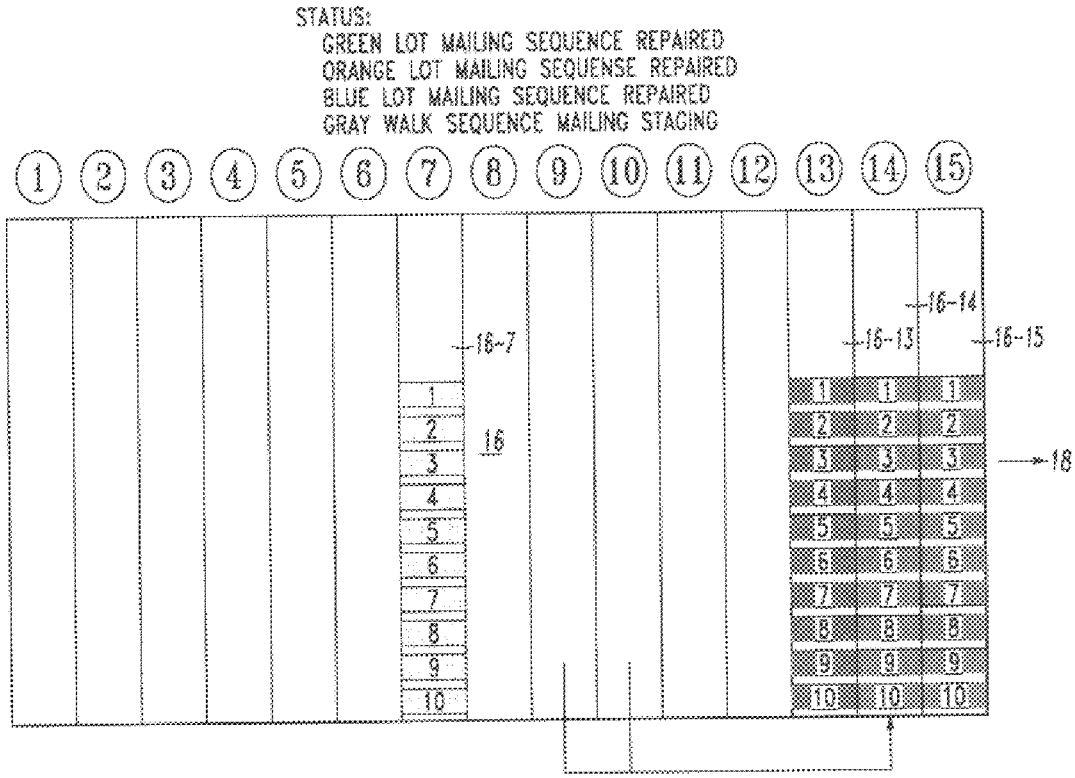
Figure 4H:
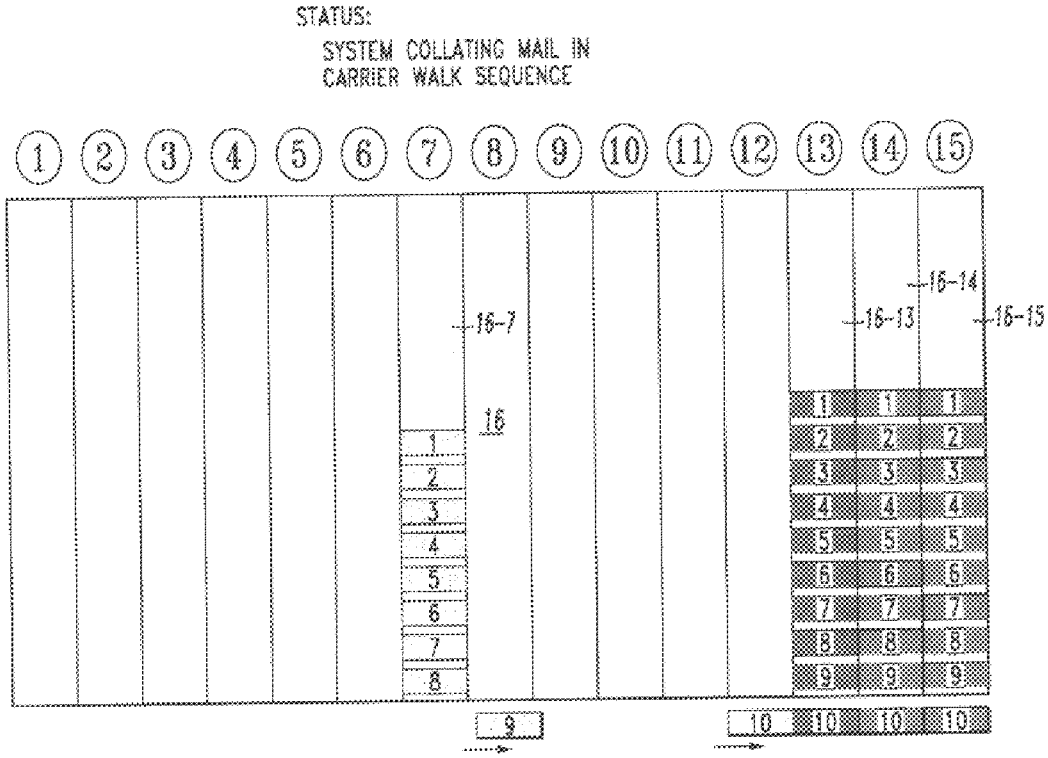
Figure 4I:
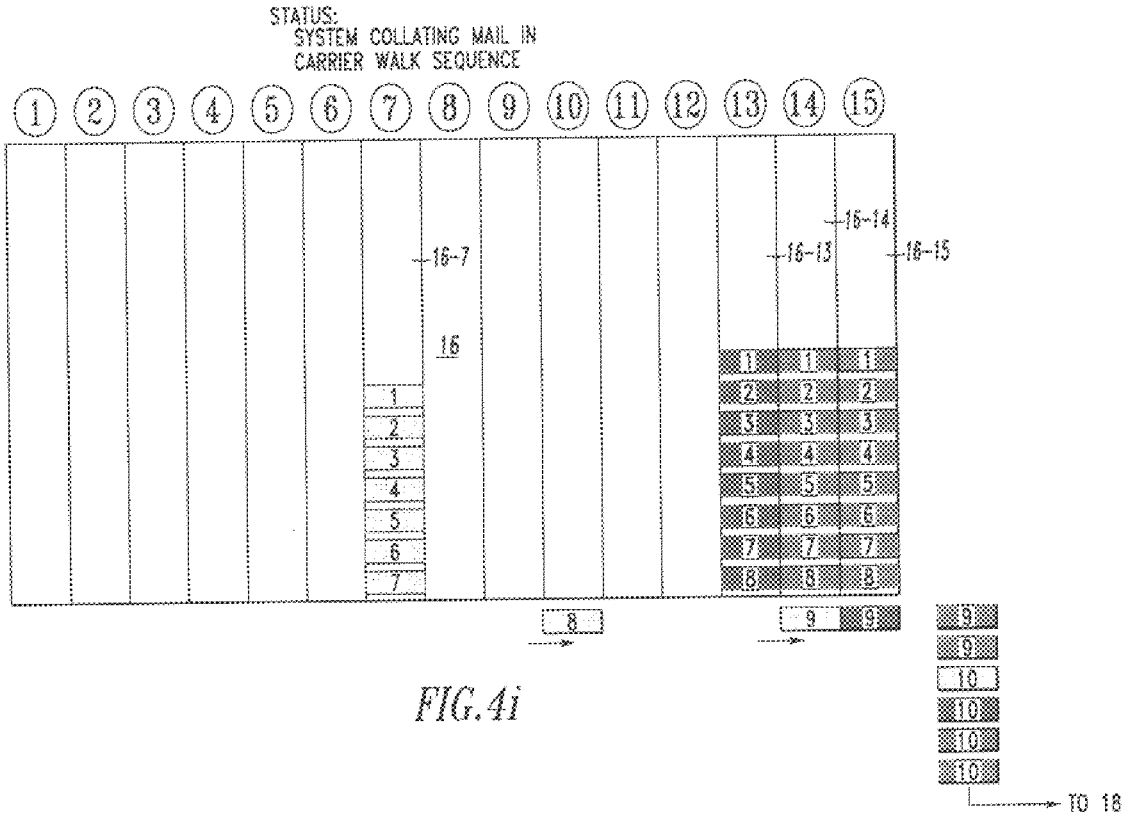
Figure 4J:
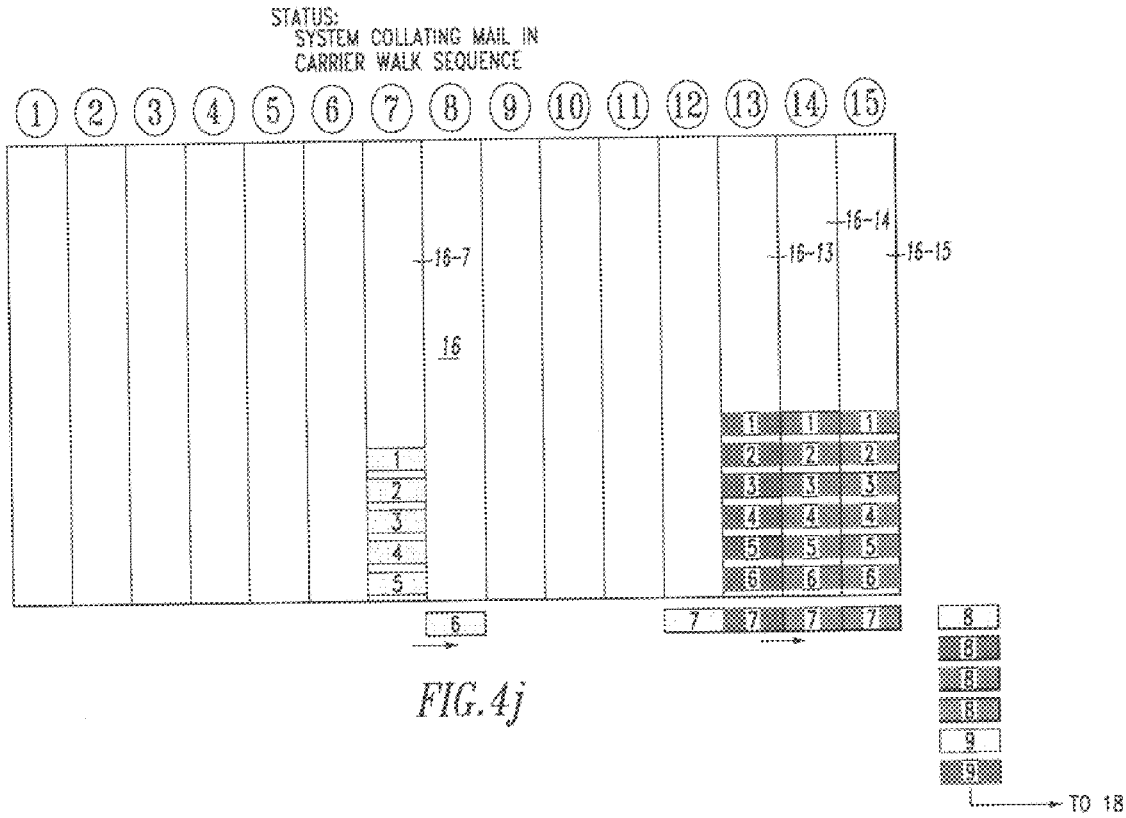
Figure 4K:
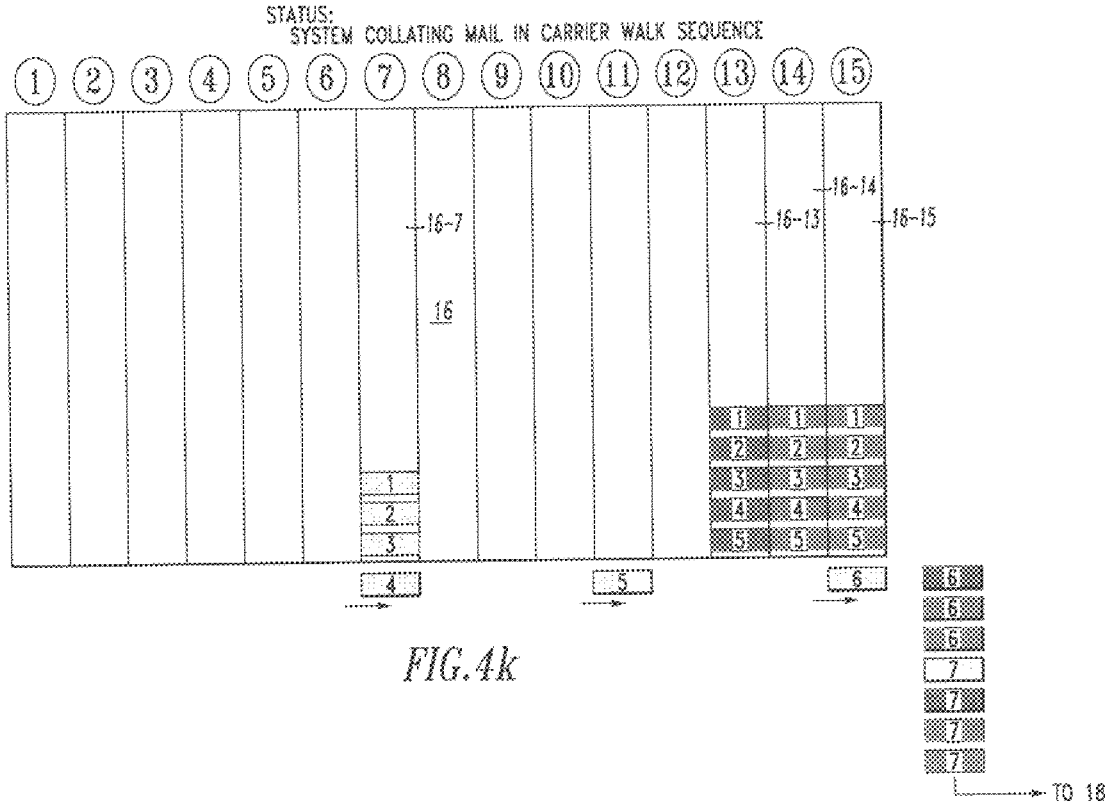
Figure 41:
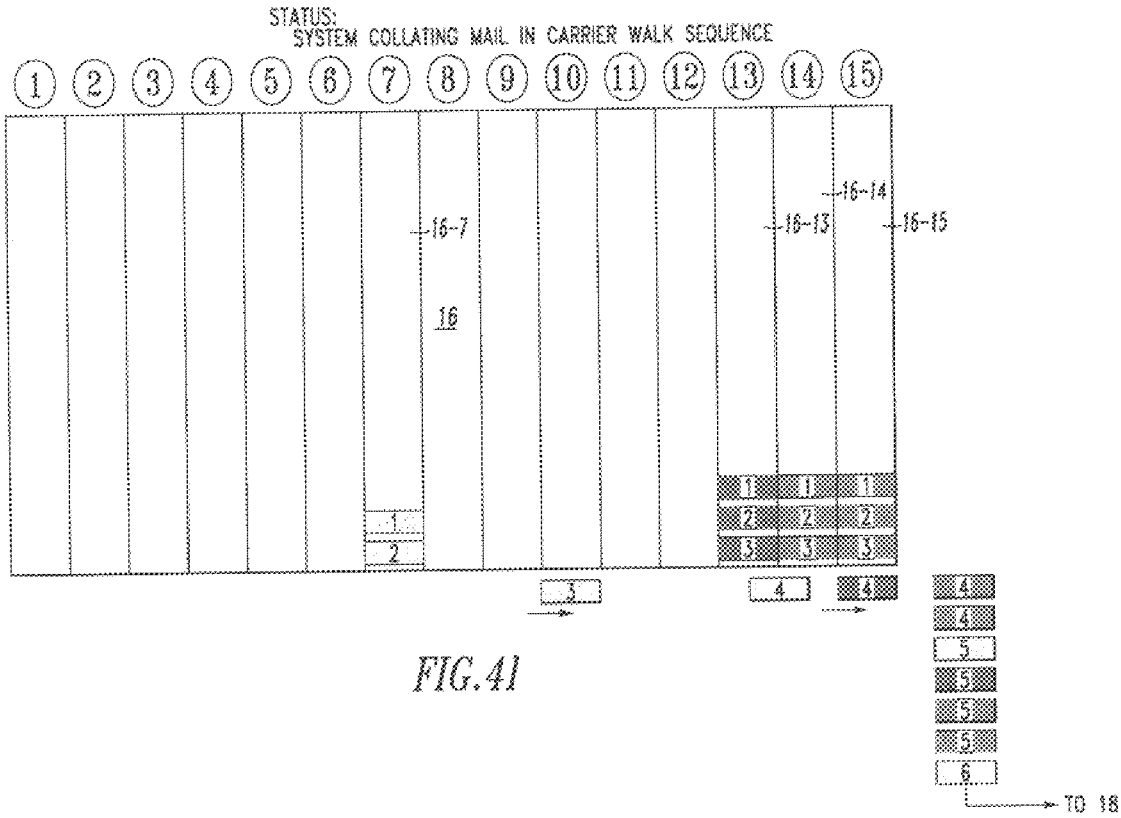
Figure 4M:
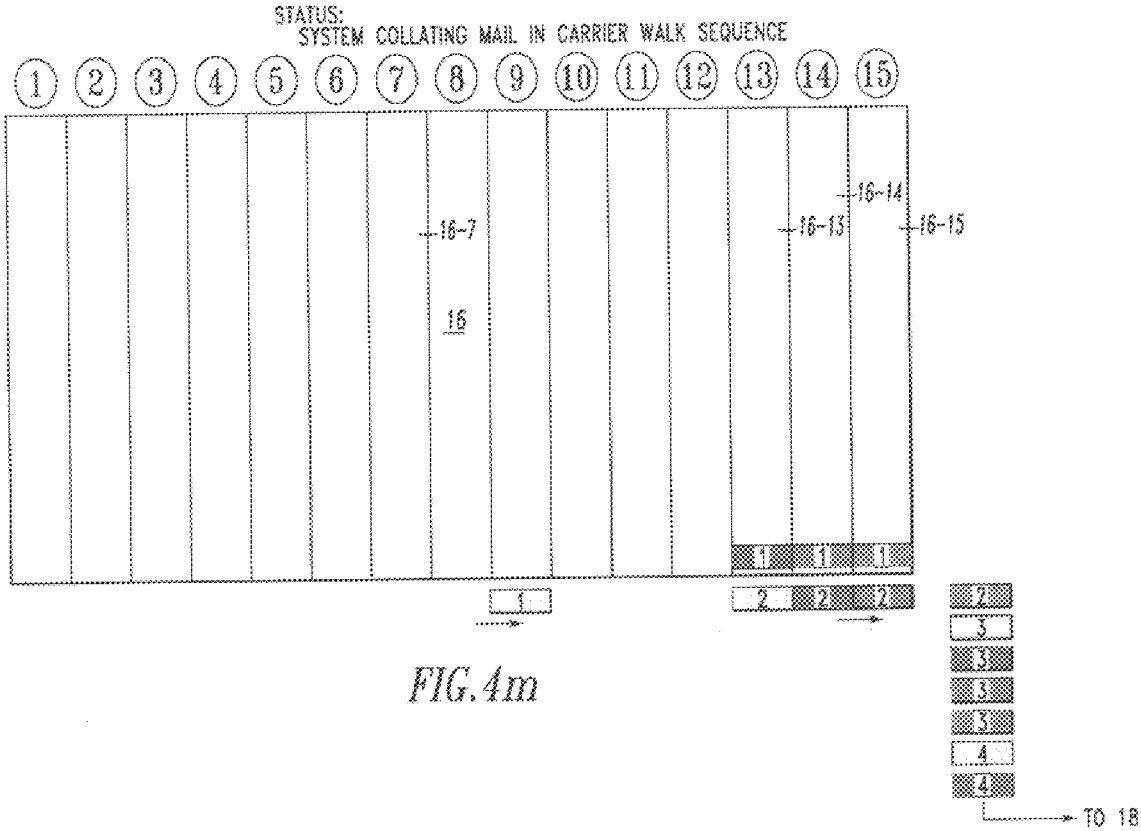
Figure 4N:
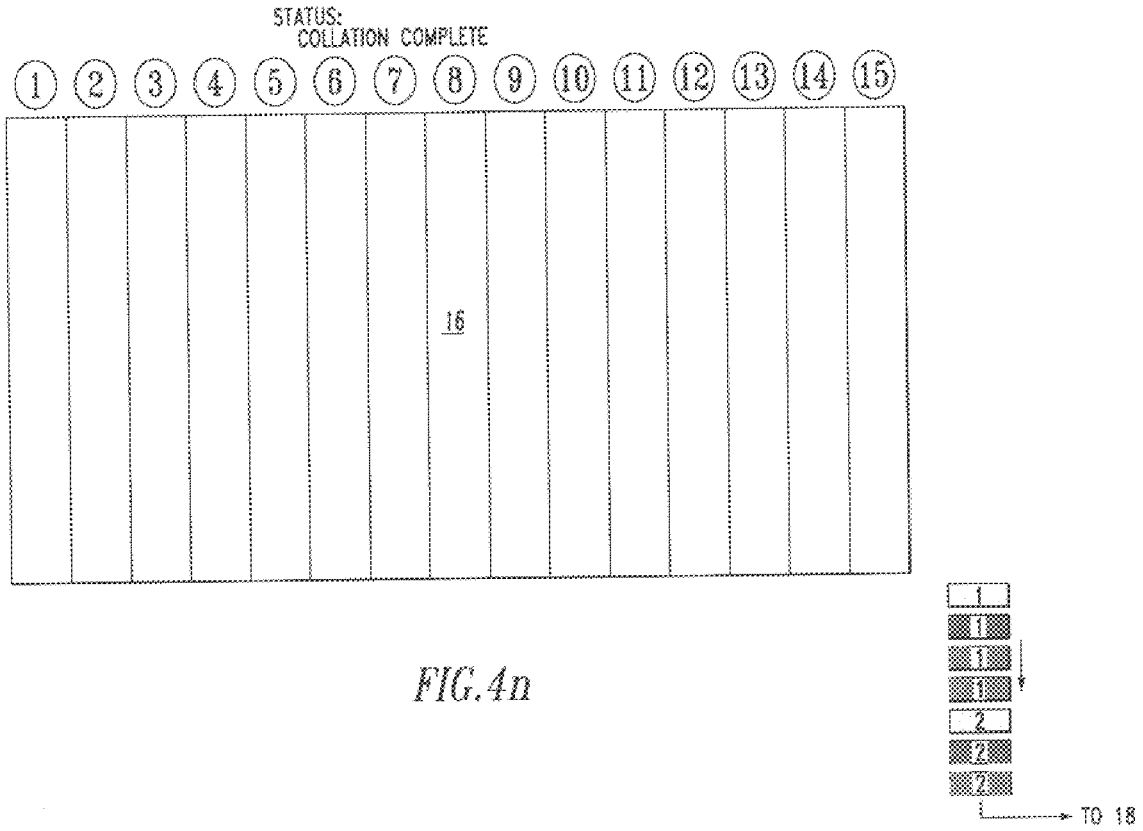

FIGS. 4*a* to 4*n* show this process being performed on three LOT mailings and a carrier walk sequence (CWS) mailing. The delivery point sequence numbers are shown on each mail piece. This example shows the process for the route depicted in FIG. 1 and Table 2.

Once a mailing has been staged, sequence repair is accomplished as follows:

1. Mailings, as compared to CWS, in reverse order temporarily remain staged (FIG. 4*c*, see green LOT).
2. Mailings in proper order are passed to a downstream tower within the system. Because the staging system is LIFO (Last-In-First-Out), the order of the pieces is reversed (i.e. the last piece into the original tower is the first piece into the downstream tower). (FIG. 4*c,* greet LOT)
3. Upon completion of step 2, all mini mailings are now staged in reverse order. (FIGS. 4*e* to 4*g*)
4. All mini mailings are now passed from their towers and collated into another downstream tower as a single, in sequence mailing. (FIGS. 4*h* to 4*n*)
5. While steps 1–4 are occurring, mail for other mailings is being fed into upstream towers and repaired in the same manner.
6. Mailings that are in correct sequence (i.e. mailings prepare in carrier walk sequence) are simply staged and do not require sequence repair. (FIG.4*g,* gray CWS)
7. After all mailings have been fed, the system collates them during output into a single, multi-mailing bundle in carrier walk sequence. (FIG. 4*n*)

Referring in general to the diagrammatic illustrations of FIGS. 4*a* to 4*n,* there is illustrated fifteen (15) vertical towers, 16-1, . . . 16-15, as part of the staging tower assembly 16. The input end to the staging tower assembly 16 is indicated by reference numeral 10, and the output end where collated mail items are collected in tubs for delivery by carriers is designated 18.

Batches of mail fed into the system at input end 10 are either in line of travel (LOT) or carrier walk sequence (CWS), and are color-coded with appropriate hatching. For example, the mail items color-coded as green represent a first LOT batch; orange items a second LOT batch; blue items a third LOT batch; and gray items a batch already in carrier walk sequence (CWS).

In the example illustrated in FIGS. 4*a* to 4*n,* each batch has ten (10) mail items numbered "1" to "10". Therefore, using this numbering system, carrier walk sequence (CWS) would entail delivery of all items "1" to "10" in that order to destination points on a carrier route. So all mail items from each batch must be collated and merged by the staging tower assembly, and the operational software of its computer control system so that all items "1" are together, "2" together, etc. . . . "10" together.

All items in each of the towers 16-1, . . . 16-15 are ultimately to be arranged in descending order, "10" to "1" from the bottom up in the towers in a last-in-first-out (LIFO) arrangement. This is because in order to load mail items in CWS mail tubs at collection station 18, items must be loaded in those tubs in reverse sequence, namely, "10" . . . "1", so that items may be retrieved from the tubs as delivered in a "1" to "10" order, (CWS).

However, before achieving CWS in the respective towers, items in the LOT batches must be rearranged into repaired sequences reflecting CWS. This is done by separate the LOT batches into "mini mailings" by forming a first "mini mailing" of those items that are in a reverse sequence, as compared to CWS, namely, "1" to "10". In the example shown, the items in the respective LOT batches in reverse order are items "8", "7", "6" and "5". Of course these conditions may vary from one LOT batch to another.

Once the reverse order items are identified, such as by the code reader 12 (FIG. 3), these items are separated into "mini mailings" in a selected tower 16-i and staged therein in ascending order from bottom to top. The remaining items of that LOT batch, which are in the same order as CWS are then staged in another tower in descending order from bottom to top.

Using the sort plan software of the flats bundle collator system in accordance with the present invention, the two "mini mailings" for the given LOT batch are then combined into carrier walk sequence (CWS) in a third downstream tower 16-k in descending order from bottom to top in a LIFO arrangement. Items from all towers are then merged into carrier walk sequence (CWS), wherein all like destination point mail items are contiguously arranged.

The entire sequence repair process described above can be readily followed by sequentially referring to drawing FIGS. 4*a* to 4*n*. For example, in FIG. 4*a,* green and orange LOT mail batches are illustrated as being conveyed in sequence from feeder 10 into the staging tower assembly 16, including fifteen(15) exemplary towers or storage units 16-1, . . . 16-15.

In FIG. 4*b,* the orange and green LOT batches are depicted as being fed along the conveyor in line past the respective bottom openings to the towers 15-1, . . . 15-12, while a third blue LOT batch is entering feeder 10. In FIG. 4*b* mail items "8", "7", "6", "5" are identified as being items in reverse sequence as compared to the carrier walk sequence (CWS).

Accordingly, these reverse sequence items of the green LOT batch are stored in ascending order in tower 16-13, and the in sequence items of the green LOT are stored in descending order in tower 16-12 as shown in FIG. 4*c*. FIG. 4*c* also illustrates that simultaneously a walk sequence batch of mail items "1" . . . "6" color-coded as gray is now entering the feeder 10 just behind the blue LOT batch item "10". At the same time, the orange LOT batch is disposed in-line below the tower openings of towers 16-2, . . . 16-11, and is ready to be separated into "mini mailings" in a similar fashion to that already accomplished for the green LOT batch.

Referring now to FIG. 4*d,* the orange LOT batch is depicted as being arranged into "mini mailings" of ascending and descending order in towers 16-11 and 16-10, respectively. At the same time, blue LOT batches are being presented for staging in the towers by its in-line position adjacent to the bottom openings of the first nine(9) towers 16-1, . . . 16-9.

In FIG. 4*e,* the green LOT batch has been re-sequenced and disposed in a repaired sequence, which corresponds to carrier walk sequence (CWS) in downstream tower 16-15. This is achieved by combining the two "mini mailings" of the green LOT batches previously stored in the towers 16-13 and 16-14 into one integrated repaired sequence as shown. At this time, the orange LOT and blue LOT batches in towers 16-11, 16-12 and 16-8, 16-9 are staged as separate "mini mailings" in preparation for re-sequencing into repaired sequences consistent with carrier walk sequence (CWS). Also illustrated in FIG. 4*e* is the beginning of the staging of the gray carrier walk sequence (CWS) batch in descending order in tower 16-7.

In FIG. 4*f,* the orange LOT "mini mailings" have been rearranged into carrier walk sequence (CWS), and transferred into tower 16-14 from towers 16-11 and 16-12, the blue LOT "mini mailings" are stored in towers 16-9 and 16-10, and the gray carrier walk sequence CWS mailing needing no sequence repair is staged in tower 16-7 in descending order from bottom to top.

Continuing on with the process as depicted in FIGS. 4*g,* the blue LOT batch, as well as all other batches, e.g. the orange, green and gray LOT batches are now staged in carrier walk sequence (CWS) in descending order from bottom to top in towers 16-7, 16-13, 16-14 and 16-15. Therefore, all mail items from the respective batches are ready for collation.

The collation process can be followed by reference to FIGS. 4*h* to 4*n,* wherein all like numbered mail items "10" to "1" from the four (4) batches are collated together in respective sets which are fed sequentially into a single output stream resulting in all of the of mail items being arranged in carrier walk sequence (CWS) at collection station 18. For example, in FIG. 4*h,* the "10" items are collated. This followed by "9" items being collated as shown in FIG. 4*i*. The process continues until the "1" items are collated as shown in FIGS. 4*m* and 4*n*.

As the example shown in FIG. 4*a* to 4*n* demonstrate, the Flats Bundle Collator, as modified by the present invention, is capable of processing mailings that contain mail pieces that are out-of-order, mis-sequenced or in improper sequence (such as ascending rather than descending). This capability is enabled by the inherent characteristics of the system design and applied processes. The dissection of mailings into contiguous segments of sequenced mail (both ascending and descending) and the subsequent manipulation of these segments into completely sequenced mailings allow the system to produce a properly sequenced, collated stream of mail ready for delivery.

The application of this technology will allow the USPS to process the existing mail base on an FBC system, and eliminate the need for investment through incentives to mailers to configure mailings into carrier walk sequence. The system is capable of fully processing carrier walk sequence and LOT mailings simultaneously.

What is claimed is:

1. A method of collating a plurality of items into a final sequenced set of the items in preparation for delivery to predetermined delivery points, some items being pre-sequenced according to a prioritized order reflecting the delivery points, and other items being in a different order than the prioritized order, comprising the steps of:

forming a single input stream of the items;

transporting the items from the input stream to a staging station;

sampling items in the input stream to determine if the sampled items are part of the pre-sequenced prioritized order or are in said different order;

sorting the pre-sequenced items in the prioritized order at the staging station into one or more subsets of items re-sequenced into an intermediate order, as an intermediate step to achieving said final sequenced set;

rearranging the items in the different order into a repaired sequence reflecting the prioritized order, and inserting items of the repaired sequence into one or more subsets at the staging station;

merging all items output from the staging station into a single output stream from the respective subsets of items into said final sequenced set; and collecting portions of the output stream of items consistent with the sequence of the final sequenced set to form batches of items in the prioritized order reflecting a preferred sequence of the delivery points.

2. The method of claim 1 wherein the different order has delivery points that partially overlap delivery points in the prioritized order such that some items in the different order are sequenced corresponding to some of the delivery points of items in the prioritized order.

3. The system of claim 2 wherein some of the items in the different order are sequenced in an ascending order relative to delivery points in the prioritized order.

4. The system of claim 2 wherein some of the items in the different order are sequenced in a descending order relative to delivery points in the prioritized order.

5. The method of claim 1 wherein the different order is a random order.

6. The method of claim 1 wherein the step of rearranging comprises the steps of:

1) determining which items in the input stream are in order with the prioritized order, and which are in reverse order with respect thereto;
2) separating the in-order items and reverse-order items into separate subsets of items in the staging station; and
3) recombining the subsets in the staging station into one sequenced group of items in the prioritized order.

7. A system for collating a plurality of items into a final sequenced set of the items in preparation for delivery to predetermined delivery points, some items being pre-sequenced according to a prioritized order reflecting the delivery points, and other items being in a different order than the prioritized order, comprising:

means for forming a single input stream of the individual items;

means for transporting the items from the input stream to a staging station;

means for sampling items in the input stream to determine if the sampled items are part of the pre-sequenced prioritized order or are in said different order;

means for sorting the pre-sequenced items in the prioritized order at the staging station into a plurality of subsets of items re-sequenced into an intermediate order, as an intermediate step to achieving said final sequenced set;

means for rearranging the items in the different order into a repaired sequence reflecting the prioritized order, and inserting items of the repaired sequence into one or more subsets at the staging station;

means for merging all items output from the staging station into a single output stream from the respective subsets of items into said final sequenced set; and means for collecting portions of the output stream of items consistent with the sequence of the final sequenced set to form batches of items in the prioritized order reflecting a preferred sequence of the delivery points.

8. The system of claim 7 wherein the different order has delivery points that partially overlap delivery points in the prioritized order such that some items in the different order are sequenced corresponding to some of the delivery points of items in the prioritized order.

9. The system of claim 8 wherein some of the items in the different order are sequenced in an ascending order relative to delivery points in the prioritized order.

10. The system of claim 8 wherein the items in the different order are sequenced in a descending order relative to delivery points in the prioritized order.

11. The system of claim 7 wherein the different order is a random order.

12. The system of claim 7 wherein said means for rearranging comprises:

1) means for determining which items in the input stream are in order with the prioritized order, and which are in reverse order with respect thereto;
2) means for separating the in-order items and reverse-order items into separate subsets of items in the staging station; and
3) means for recombining the subsets in the staging station into one sequenced group of items in the prioritized sequence.

13. The method of claim 12 comprising the further step of:

collecting portions of the output stream of the mail items in delivery point sequence and reversing the order thereof into batches of mail items in carrier walk sequence (CWS).

14. A method of collating a plurality of mail items into a final sequenced set of the items for delivery to predetermined delivery points, some of said mail items being pre-sequenced in delivery point sequence (DPS) of selected carrier routes, and other mail items being in a different order from the delivery point sequence, comprising the steps of:

a) feeding the mail items from a single input stream to a staging station;
b) sampling each mail item in the input stream to determine if the mail item is in the delivery point sequence, or a different order;
c) sorting the mail items at the staging station into one or more of subsets of mail items re-sequenced into an intermediate order, as an intermediate step to achieving said final sequenced set, said staging station having a plurality of storage units $X_1$ to $X_n$, wherein n is the total number of storage units, said storage units temporarily storing said items in said subsets by;
   1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items;
   2) rearranging the mail items in the different order into delivery point sequence (DPS) in the staging station by inserting those mail items into one or more selectable storage units; and
   3) selectively extracting the mail items from any selected one of the storage units $X_1$ to $X_n$ according to said extraction plan; and
d) merging the extracted mail items into a single output stream from the respective subsets of mail items into said final sequenced set in delivery point sequence (DPS).

15. The method of claim 14 wherein the different order is in enhanced carrier route line of travel (LOT), as defined by the United States Postal Service (USPS), such that some of the mail items therein are sequenced corresponding to some of the delivery points of mail items in the delivery point sequence (DPS).

16. The method of claim 15 wherein LOT is determined as a function of block face identity, and direction of carrier walk sequence (CWS) in that block, said block face identity representing a side of a street on a carrier delivery route.

17. The method of claim 15 wherein the step of rearranging comprises the steps of:

1) determining which items in the input stream are in order with CWS, and which are in reverse order with respect thereto;

2) separating the in-order items and reverse-order items into separate subsets of items in the staging station; and 3) recombining the subsets in the staging station into one sequenced group of items in CWS.

18. The method of claim 14 wherein the different order is a random order.

19. The method of claim 14 wherein the segment for sampling includes:

marking each mail item with a code that identifies prospective delivery points for the mail item and a relative order of delivery;

a segment for reading the code of each item in the input stream;

a segment for comparing the code to delivery points in a carrier walk sequence (CWS) of the selected carrier route; and a segment for determining from the comparison which items are in the delivery point sequence (DPS) for the selected carrier route and which items are in the different order.

20. The method of claim 19 wherein the code includes the carrier route zip code, a block face designation for the side of a street for each delivery point, and the delivery point for the mail item.

21. A system for collating a plurality of mail items into a final sequenced set of the items for delivery to predetermined delivery points, some of said mail items being presequenced in delivery point sequence (DPS) of selected carrier routes, and other mail items being in a different order from the delivery point sequence, comprising:

a) means for feeding the mail items from a single input stream to a staging station;

b) means for sampling each mail item in the input stream to determine if the mail item is in the delivery point sequence, or a different order;

c) means for sorting the mail items at the staging station into one or more subsets of mail items re-sequenced into an intermediate order, as an intermediate step to achieving said final sequenced set, said staging station having a plurality of storage units $X_1$ to $X_n$, wherein n is the total number of storage units, said storage units temporarily storing said items in said subsets by the combined operation of;

1) means for inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items;

2) means for rearranging the mail items in the different order into delivery point sequence (DPS) in the staging station by inserting those mail items into selectable storage units; and 3) means for selectively extracting the mail items from any selected one of the storage units $X_1$ to $X_n$ according to said extraction plan; and d) means for merging the extracted mail items into a single output stream from the respective subsets of mail items into said final sequenced set in delivery point sequence (DPS).

22. The system of claim 21 further comprising:

means for collecting portions of the output stream of the mail items in delivery point sequence and reversing the order thereof into batches of mail items in carrier walk sequence (CWS).

23. The system of claim 21 wherein the different order is in enhanced carrier route line of travel (LOT), as defined by the United States Postal Service (USPS), such that some of the mail items therein are sequenced corresponding to some of the delivery points of mail items in the delivery point sequence (DPS).

24. The system of claim 23 wherein LOT is determined as a function of block face identity, and direction of carrier walk sequence (CWS) in that block, said block face identity representing a side of a street on a carrier delivery route.

25. The system of claim 23 further comprising:

1) means for determining which items in the input stream are in order with CWS, and which are in reverse order with respect thereto;

2) means for separating the in-order items and reverse-order items into separate subsets of items in the staging station; and 3) means for recombining the subsets in the staging station into one sequenced group of items in CWS.

26. The system of claim 21 wherein the different order is a random order.

27. The system of claim 21 wherein the means for sampling includes:

means for marking each mail item with a code that identifies prospective delivery points for the mail item and a relative order of delivery;

means for reading the code of each item in the input stream;

means for comparing the code to delivery points in a carrier walk sequence (CWS) of the selected carrier route; and means for determining from the comparison which items are in the delivery point sequence (DPS) for the selected carrier route and which items are in the different order.

28. The system of claim 27 wherein the code includes the carrier route zip code, a block face designation for the side of a street for each delivery point, and the delivery point for the mail item.

29. A computer program embodied in a machine-readable medium for collating a plurality of mail items into a final sequenced set of the items for delivery to predetermined delivery points, some of said mail items being presequenced in delivery point sequence (DPS) of selected carrier routes, and other mail items being in a different order from the delivery point sequence from items fed from a input stream to a staging station, the program comprising:

a) a segment for sampling each mail item in the input stream to determine if the mail item is in the delivery point sequence, or a different order;

b) a segment for sorting the mail items at the staging station into one or more subsets of mail items re-sequenced into an intermediate order, as an intermediate step to achieving said final sequenced set, said staging station having a plurality of storage units $X_1$ to $X_n$ wherein n is the total number of storage units, said storage units temporarily storing said items in said subsets by instructions from the program for;

1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items;

2) rearranging the mail items in the different order into delivery point sequence (DPS) in the staging station by inserting those mail items into selectable storage units; and 3) selectively extracting the mail items from any selected one of the storage units $X_1$ to $X_n$ according to said extraction plan.

30. The computer program of claim 29 wherein the instruction for rearranging comprises:

1) a segment for determining which items in the input stream are in order with CWS, and which are in reverse order with respect thereto;

2) a segment for separating the in-order items and reverse-order items into separate subsets of items in the staging station; and 3) a segment for recombining the subsets in the staging station into one sequenced group of items in CWS.

31. A computer program embodied in a digital signal for collating a plurality of mail items into a final sequenced set of the items for delivery to predetermined delivery points, some of said mail items being pre-sequenced in delivery point sequence (DPS) of selected carrier routes, and other mail items being in a different order from the delivery point sequence from items fed from a input stream to a staging station, the program comprising:

a) a segment for sampling each mail item in the input stream to determine if the mail item is in the delivery point sequence, or a different order;

b) a segment for sorting the mail items at the staging station into one or more subsets of mail items re-sequenced into an intermediate order, as an intermediate step to achieving said final sequenced set, said staging station having a plurality of storage units $X_1$ to $X_n$, wherein n is the total number of storage units, said storage units temporarily storing said items in said subsets by instructions from the program for;

1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items;

2) rearranging the mail items in the different order into delivery point sequence (DPS) in the staging station by inserting those mail items into selectable storage units; and 3) selectively extracting the mail items from any selected one of the storage units $X_1$ to $X_n$ according to said extraction plan.

32. The computer program of claim 31 wherein the instruction for rearranging comprises:

1) a segment for determining which items in the input stream are in order with CWS, and which are in reverse order with respect thereto;

2) a segment for separating the in-order items and reverse-order items into separate subsets of items in the staging station; and 3) a segment for recombining the subsets in the staging station into one sequenced group of items in CWS.

33. A method of converting a group of mail items in enhanced line of travel sequence (LOT) into a group of items in carrier walk sequence (CWS) comprising the steps of:

a) feeding a single input stream of mail items in the LOT group into a staging station;

b) determining which items in the stream are in order with the order of CWS, and which are in reverse order with respect thereto;

c) separating the in-order items and reverse-order items into separate subsets of items in the staging station; and d) recombining the subsets in the staging station into one sequenced group of items in CWS.

34. The method of claim 33 wherein the in-order items are staged in a first vertical stack in descending order from bottom to top of the first stack; and the reverse order items are staged in a second vertical stack in ascending order from bottom to top of the stack, said step of recombining merging the first and second stacks into a third vertical stack in descending order from bottom to top in said CWS.

* * * * *